US007334299B2

(12) United States Patent
Assarsson

(10) Patent No.: US 7,334,299 B2
(45) Date of Patent: Feb. 26, 2008

(54) DEVICE IN A BUNDLE TIE

(75) Inventor: Inge Assarsson, Götene (SE)

(73) Assignee: Gepe Development AG, Zug (CH)

( * ) Notice: Subject to any disclaimer, the term of this patent is extended or adjusted under 35 U.S.C. 154(b) by 0 days.

(21) Appl. No.: 10/551,455

(22) PCT Filed: Mar. 25, 2004

(86) PCT No.: PCT/SE2004/000457

§ 371 (c)(1),
(2), (4) Date: Jul. 28, 2006

(87) PCT Pub. No.: WO2004/087520

PCT Pub. Date: Oct. 14, 2004

(65) Prior Publication Data

US 2007/0039136 A1 Feb. 22, 2007

(30) Foreign Application Priority Data

Apr. 3, 2003 (SE) ..... 0300979

(51) Int. Cl.
*F16L 3/137* (2006.01)

(52) U.S. Cl. ..... 24/16 PB

(58) Field of Classification Search .... 24/16 R–17 AP, 24/16 PB, 30.5 R–30.5 L; 248/74.3; 292/307 A, 292/325

See application file for complete search history.

(56) References Cited

U.S. PATENT DOCUMENTS 3,086,265 A * 4/1963 Orenick et al. ..... 24/30.5 P
3,147,522 A * 9/1964 Schumm ..... 24/16 PB
3,206,813 A * 9/1965 Schumm ..... 24/16 PB
3,206,814 A * 9/1965 Schumm ..... 24/20 TT
3,576,054 A * 4/1971 Rynk ..... 24/16 PB
3,837,047 A * 9/1974 Bunnell ..... 24/16 PB
5,363,536 A * 11/1994 Kleeman ..... 24/30.5 P
6,226,839 B1 * 5/2001 Sayegh ..... 24/16 PB
6,594,867 B1 * 7/2003 Pettersson ..... 24/16 PB

FOREIGN PATENT DOCUMENTS

WO WO 99/18005 4/1999

OTHER PUBLICATIONS

International Search Report and Written Opinion.

* cited by examiner

*Primary Examiner*—James R. Brittain
(74) *Attorney, Agent, or Firm*—Harness, Dickey & Pierce, P.L.C.

(57) ABSTRACT

A device in a cable tie is disclosed. The device includes an elongate band part of a certain width and thickness, which at one end has an elongate insertion narrower than the band part and terminates in a grip tab, and at its other end has a locking head. The locking head has, on the one hand, a through-opening which is intended for the band part and has substantially the same width as the band part but a height greater than the thickness of the band part and, on the other hand, a slot-shaped recess in one transverse wall of the opening, the width of which recess is such that it will allow the insertion part to be inserted into the opening via the recess, forming a band loop. On the band part there is toothing and in the locking head a locking tongue provided with toothing, which are designed, by way of a positive interlock, to lock the band part in relation to the locking head. In the area around the connection of the insertion part to the grip tab, there are wing-like projections extending transversely and out from the insertion part, which are thinner than the grip tab and which towards the latter terminate in a ridge. In forming the band loop, the ridge is designed, with the projections inserted into the through-opening of the locking head and engaging with the opposing walls of the opening, to abut the locking head. The fact that the projections are of thinner than the grip tab creates a clearance interval between the insertion part and the locking tongue.

2 Claims, 1 Drawing Sheet

DEVICE IN A BUNDLE TIE

PRIORITY STATEMENT

This application is the national phase under 35 U.S.C. § 371 of PCT International Application No. PCT/SE2004000457 which has an International filing date of Mar. 25, 2004, which designated the United States of America and which claims priority on Swedish Patent Application number 0300979-2 filed Apr. 3, 2003, the entire contents of which are hereby incorporated herein by reference.

FIELD

At least one embodiment of the present invention generally relates to a device in a cable tie.

BACKGROUND

Prior art in this field is disclosed by WO 99/180 05.

A particular advantage with a cable tie having an open locking head, that is to say a cable tie, the locking head of which has a slit for an insertion part allowing the band to be rapidly inserted into the locking head, is the facility for producing a suspendable loop, which can be opened and which allows bundles of wires, which are to be subsequently tied together, to be easily threaded through the loop. It has emerged, however, that the locking tongue providing with ratchet teeth, which is situated in the locking head and is intended, as the tie is being tightened, to be brought into engagement with ratchet teeth or ribs on the band, can be damaged so that the engagement between the locking tongue and the ribbing is impaired, with the risk that the cable tie will cease to function.

SUMMARY

At least one embodiment of the invention prevents such damage to the locking tongue.

BRIEF DESCRIPTION OF THE DRAWINGS

Advantageous and example embodiments of the invention will be explained in more detail below with reference to the drawing attached in which.

DETAILED DESCRIPTION OF THE EXAMPLE EMBODIMENTS

Figure 2A:
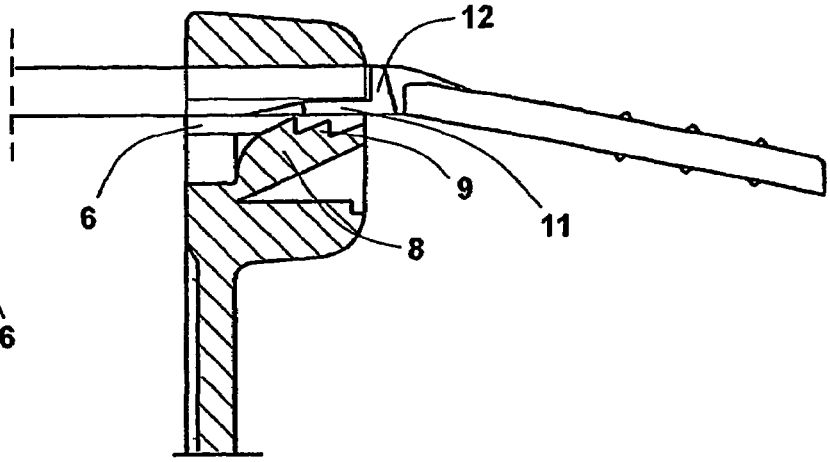
FIGS. 2*a*, 2*b*, in sections along and through the band respectively, show how the device according to an embodiment of the invention achieves a clearance interval between the insertion part of the cable tie and the locking tongue thereof.
Figure 1:
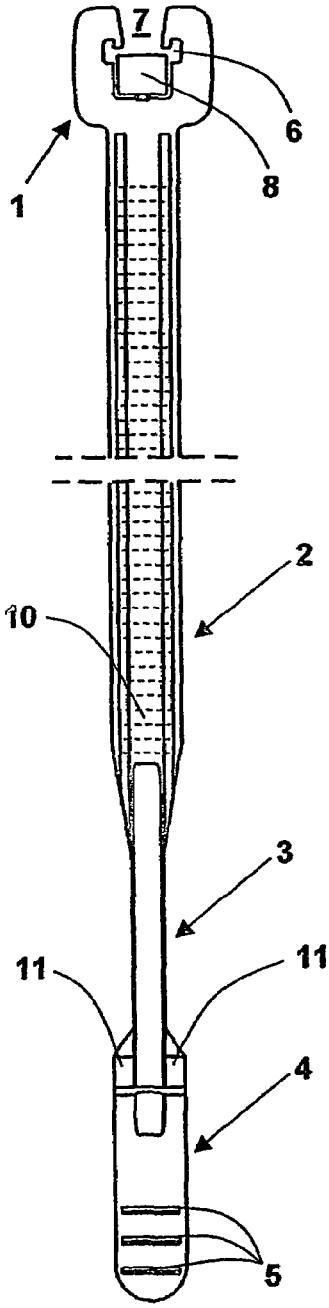
FIG. 1 shows a plan view of a cable tie having a device according to an embodiment of the invention.

The embodiment of a cable tie according to the present invention shown in FIG. 1 comprises a housing part 1, a band part 2, an insertion part 3 narrower than the band part 2, and an end part 4 serving as grip tab. The band part 2 is in principle of any length, as is the insertion part 3, although the latter should be at least equal in length to the housing 1. The end part 4 is wider than the band part 2 and is provided on at least one side with ridges 5 in order to facilitate gripping of the part when tightening the band around a cable bundle or the like, for example.

The housing 1 is provided with a through-opening 6, which extends in the longitudinal direction of the housing 1 and transversely to the band parts 2-4. A slot-shaped recess 7 extends through the upper wall of the housing and is of a width designed to match the insertion part 3 and outwardly bevelled edges, which may also be regarded as guide edges for bringing the insertion part 3 down into the through-opening 6. A locking member in the form of a tongue 8 is arranged in the through-opening 6. The tongue 8 emerges from the bottom of the through-opening 6 and basically extends diagonally towards the opposite end of the opening 6 and towards the slot-shaped recess 7. On the side facing the slot-shaped recess 7 the tongue 8 is provided with a number of ratchet teeth 9, which are intended to interact with corresponding ratchet teeth 10 on the band part 2.

The fact that the shape of the end part 4 prevents it running through the opening 6 means that an openable loop, which loosely encloses a bundle of cables, for example, can be produced by bringing the insertion part 3 down into the recess 7. Further cables can be inserted through this loop, as required before the cable tie is tightened. After threading the band part 3 into the through-opening 6 on top of the tongue 8 this will be pressed down towards the bottom of the opening 6 by the aforementioned cable tie. It has emerged that there is not always sufficient resilience to ensure engagement between the teeth 9 and 10, with the result that the aforementioned problems arise.

Figure 2B:
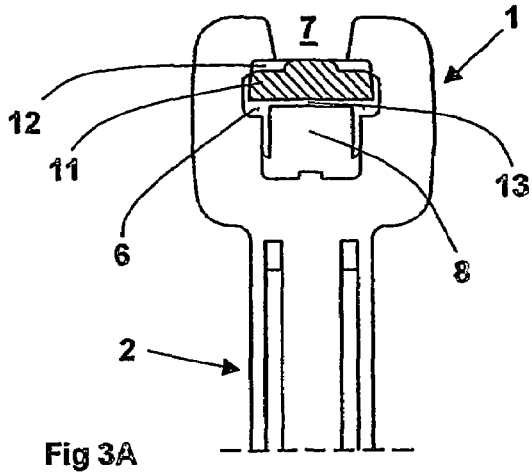

According to an embodiment of the invention, there are wing-like projections 11, thinner than the grip tab 4 and extending transversely to the insertion part 3 in the area around the connection of the insertion part 3 to the grip tab 4. Towards the grip tab 4 these projections 11 terminate in a ridge 12 serving as a stop, which ridge in forming the band loop as stated above is designed, with the projections 11 inserted into the through-opening 6 of the locking head 1 and bearing against the opposing walls of the opening 6 to abut the locking head 1. The fact that the projections 11 are thinner than the grip tab 4 creates a clearance interval 13 between the insertion part 3 and the locking tongue 8, which ensures that the tongue 8 is always in the position in which its teeth 9 afford effective locking through engagement with the teeth 10 of the band 2. This clearance interval 13 is clearly visible from FIG. 2*b*.

Figure 3B:
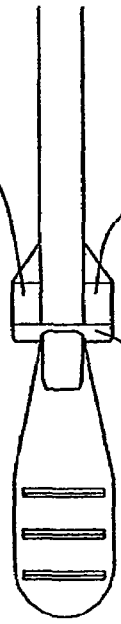
FIG. 3*b* is a detailed view of an alternative embodiment of a device according to the invention.
Figure 3A:
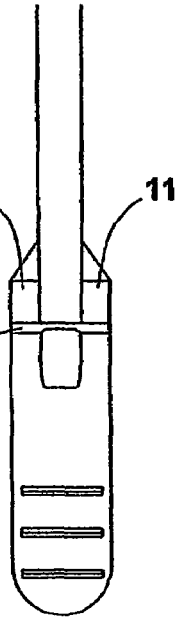
FIG. 3*a* shows a detailed view of the device according to an embodiment of the invention in the embodiment shown in FIG. 1.

In the preferred embodiment shown in FIGS. 1 and 3*a*, the projections 11 and the ridge 12 are incorporated into the grip tab 4. In the embodiment shown in FIG. 3*b* the grip tab 4 emerges from the ridge 12 and therefore constitutes an independent section.

The invention claimed is:

1. Device in a cable tie, comprising:

an elongate band part of a width and thickness, at one end the elongate band part including an elongate insertion part, relatively narrower than the elongate band part and terminating in a grip tab, and at an other end the elongate band part including a locking head, the locking head including a through-opening, intended for the elongate band part and relatively wider than the elongate band part and including a height relatively greater than a thickness of the elongate band part, and a slot-shaped recess in a wall of the through-opening, the width of the slot-shaped recess being such to allow the elongate insertion part to be inserted into the through-opening via the slot-shaped recess, forming a band loop, the elongate band part further including toothing on the elongate band part and a locking tongue provided with toothing in the locking head, designed, by way of a positive interlock, to lock the elongate band part in relation to the locking head, wherein, in an area around a connection of the elongate insertion part to the grip tab, wing-like projections extend transversely and out from the elongate insertion part, the wing-like projections being relatively thinner than the grip tab to create a clearance interval between the elongate insertion part and the locking tongue and the wing-like projections, towards the grip tab, terminate in a ridge forming the band loop, the wing-like projections being inserted into the through-opening of the locking head and bearing against the opposing walls of the through-opening, to abut the locking head.

2. Device according to claim 1, wherein the projections are incorporated into the grip tab.

* * * * *